US007571761B2

(12) United States Patent
Katoh et al.

(10) Patent No.: US 7,571,761 B2
(45) Date of Patent: Aug. 11, 2009

(54) HEAT EXCHANGER

(75) Inventors: Yoshiki Katoh, Chita-gun (JP); Masaaki Kawakubo, Obu (JP); Etsuo Hasegawa, Nagoya (JP)

(73) Assignee: DENSO CORPORATION, Kariya (JP)

( * ) Notice: Subject to any disclaimer, the term of this patent is extended or adjusted under 35 U.S.C. 154(b) by 100 days.

(21) Appl. No.: 11/159,641

(22) Filed: Jun. 23, 2005

(65) Prior Publication Data

US 2005/0284621 A1 Dec. 29, 2005

(30) Foreign Application Priority Data

Jun. 28, 2004 (JP) ..... 2004-190101

(51) Int. Cl.
*F28F 9/02* (2006.01)

(52) U.S. Cl. ..... 165/174; 165/175

(58) Field of Classification Search ..... 165/41–44, 165/67, 76, 172, 173, 174, 175, 176; 180/68.4, 180/68.6
See application file for complete search history.

(56) References Cited

U.S. PATENT DOCUMENTS

| | | | | |
|---|---|---|---|---|
| 5,269,367 | A * | 12/1993 | Susa et al. | 165/41 |
| 5,474,121 | A * | 12/1995 | Bryson et al. | 165/41 |
| 5,671,803 | A * | 9/1997 | Tepas et al. | 165/41 |
| 5,934,367 | A | 8/1999 | Shimmura et al. | |
| 6,158,500 | A * | 12/2000 | Heine | 165/67 |
| 6,216,810 | B1 * | 4/2001 | Nakai et al. | 180/68.4 |
| 6,237,676 | B1 * | 5/2001 | Hasegawa et al. | 165/67 |
| 6,339,937 | B1 | 1/2002 | Makihara et al. | |
| 6,607,025 | B2 * | 8/2003 | Gille | 165/140 |
| 6,619,380 | B1 * | 9/2003 | Hartman et al. | 165/71 |
| 6,772,982 | B2 * | 8/2004 | Nakagawa et al. | 248/232 |
| 6,827,129 | B2 * | 12/2004 | Ozawa et al. | 165/67 |
| 7,150,335 | B2 * | 12/2006 | Sasano et al. | 180/68.4 |
| 2001/0008183 | A1 * | 7/2001 | Ito et al. | 165/43 |
| 2001/0042611 | A1 * | 11/2001 | Ozaki et al. | 165/67 |
| 2004/0159121 | A1 | 8/2004 | Horiuchi et al. | |
| 2005/0235691 | A1 * | 10/2005 | Katoh et al. | 62/515 |

FOREIGN PATENT DOCUMENTS

| | | |
|---|---|---|
| JP | 05-346297 | 12/1993 |
| JP | 2001-012821 | 1/2001 |
| JP | 2001-343174 | 12/2001 |
| JP | 2004-162993 | 6/2004 |

OTHER PUBLICATIONS

Notification of Reasons for Refusal dated Oct. 21, 2008 from the Japan Patent Office in the corresponding patent application No. 2004-190101 with English translation.

* cited by examiner

*Primary Examiner*—Ljiljana (Lil) V Ciric
(74) *Attorney, Agent, or Firm*—Harness, Dickey & Pierce, PLC

(57) ABSTRACT

A refrigerant evaporator includes an upstream tank portion for distributing refrigerant into all laminated tubes of a core portion. The upstream tank portion includes a first distribution passage for distributing the refrigerant into the tubes in a direction parallel to a tank longitudinal direction, a second distribution passage for distributing the refrigerant from the first distribution passage into the tubes in a tank width direction, and a communication passage through which the refrigerant from the first distribution passage is supplied to the second distribution passage after flowing in the tank longitudinal direction.

21 Claims, 12 Drawing Sheets

HEAT EXCHANGER

CROSS REFERENCE TO RELATED APPLICATION

This application is based on Japanese Patent Application No. 2004-190101 filed on Jun. 28, 2004, the contents of which are incorporated herein by reference in its entirety.

FIELD OF THE INVENTION

The present invention relates to a heat exchanger for performing heat exchange between first and second mediums. The heat exchanger can be suitably used for a refrigerant evaporator in which refrigerant of a refrigerant cycle system is evaporated.

BACKGROUND OF THE INVENTION

As a refrigerant evaporator, a multi-flow type heat exchanger is described in U.S. Pat. No. 6,339,937 (JP 2001-324290A) or a serpentine-type heat exchanger is described in JP 2001-12821A, for example. In this case, when a core width dimension of an evaporator is reduced in order to reduce the size or the weight of the evaporator, a refrigerant passage sectional area is reduced. For example, when a tank sectional area and a tube thickness dimension are reduced, a pressure loss is increased in the refrigerant evaporator. Therefore, a refrigerant distribution performance is deteriorated, and an air temperature flowing from the refrigerant evaporator becomes ununiform.

Further, in a multi-type refrigerant evaporator described in JP 2001-343174, at least two refrigerant inlets are provided in a refrigerant inlet tank. However, in this case, a piping structure for introducing the refrigerant to the refrigerant inlets becomes complex, and a dead space becomes larger. Therefore, manufacturing steps become complex.

In contrast, in a whole-pass type refrigerant evaporator (one pass type), it is difficult to improve a refrigerant distribution performance with a simple structure.

SUMMARY OF THE INVENTION

In view of the above-described problems, it is an object of the present invention to provide a heat exchanger in which a heat exchange medium can be distributed uniformly into tubes in a tube laminating direction.

It is another object of the present invention to provide a heat exchanger in which the same tank member can be used even when a core length in a tube longitudinal direction is changed.

It is further another object of the present invention to provide a refrigerant evaporator used as a heat exchanger, which can effectively improve refrigerant distribution in tubes.

According to an aspect of the present invention, in a heat exchanger, a core portion includes a plurality of tubes extending in a tube longitudinal direction in which a first medium flows, and the core portion is disposed to perform heat exchange between the first medium flowing in the tubes and a second medium passing through the core portion outside the tubes. Furthermore, an upstream tank portion is connected to one side ends of the tubes and extends in a tank longitudinal direction perpendicular to the tube longitudinal direction, for distributing and supplying the first medium into the tubes.

The upstream tank portion has a first distribution passage for distributing the first medium in the tank longitudinal direction so as to distribute the first medium into the tubes laminated in a direction parallel to the tank longitudinal direction, a second distribution passage for distributing the first medium from the first distribution passage into the tubes in a tank width direction that is perpendicular to both the tube longitudinal direction and the tank longitudinal direction, and a communication passage through which the first medium from the first distribution passage is supplied to the second distribution passage after flowing in the tank longitudinal direction. Accordingly, the first medium can be uniformly distributed into all the tubes in the tube laminating direction from the upstream tank portion.

When the heat exchanger is used as a refrigerant evaporator and the upstream tank portion is arranged at an upper side of the core portion, refrigerant can be uniformly distributed into all the tubes in the tube laminating direction from the upstream tank portion. For example, the refrigerant evaporator can be suitably used for a heat pump cycle system for a vehicle air conditioner.

Furthermore, even when the core length in the tube longitudinal direction is changed, the upstream tank portion can be suitably used for the changed core portion.

The first distribution passage, the second distribution passage and the communication passage can be provided in the upstream tank portion by stacking at least first, second and third plate members in the tube longitudinal direction.

Alternatively, the first distribution passage, the second distribution passage and the communication passage can be provided in the upstream tank portion by stacking at least first to fifth plate members in the tube longitudinal direction. For example, the first plate member is connected to the tubes of the core portion, the second plate member is stacked on the first plate member to have space holes communicating with the tubes, the third plate member is stacked on the second plate member to form the second distribution passage, the fourth plate member is stacked on the third plate member to form the communication passage, and the fifth plate member is stacked on the fourth plate member to form the first distribution passage.

In the upstream tank portion, the first distribution passage can be provided at a center area in the tank width direction, and the second distribution passage can be provided at two sides of the first distribution passage in the tank width direction, for example. Furthermore, the communication passage can be provided to extend in the tank longitudinal direction.

Alternatively, the first plate member and the second plate member can be constructed with an integrated plate, and the integrated plate has connection holes which are connected to the tubes and protrude to the core portion.

Preferably, the third plate member has space holes for forming the second distribution passage at positions corresponding to the tubes in the tank longitudinal direction, and areas of the space holes are set to be gradually larger from an end portion adjacent to a refrigerant inlet to the other end portion in the tank longitudinal direction. In this case, the refrigerant distribution in the tubes in the tube laminating direction can be further improved.

The heat exchanger can be provided with a downstream tank portion extending in the tank longitudinal direction in which the first medium flowing out of the tubes is joined. In the case, the downstream tank portion has a first joining passage for passing and joining the first medium in a direction parallel to the tube longitudinal direction, and a second joining passage for passing and joining the first medium in the tank longitudinal direction.

Furthermore, the downstream tank portion includes a partition portion for partitioning the first joining passage and the second joining passage, and the partition portion has communication holes through which the first joining passage communicates with the second joining passage. In addition, the communication holes are provided in the partition portion to prevent a bias flow of the first medium in the tubes. Therefore, the refrigerant distribution performance can be further improved. For example, the communication holes are set such that a total area of the communication holes is larger than a total passage sectional area of the tubes. The downstream tank portion may be integrated with the upstream tank portion at one end side of the core portion.

According to another aspect of the present invention, the heat exchanger includes a core portion having a plurality of tubes extending in a tube longitudinal direction in which a first medium flows. The core portion is disposed to perform heat exchange between the first medium flowing in the tubes and a second medium passing through the core portion outside the tubes, and the tubes are arranged in first and second lines in a flow direction of the second medium for forming first and second passing portions, respectively. Furthermore, an upstream tank portion is arranged for supplying and distributing the first medium into the first passing portion, a downstream tank portion is arranged for joining and discharging the first medium from the second passing portion, and the downstream tank portion is integrated to the upstream tank portion at one end side of the tubes in a tube longitudinal direction.

In the heat exchanger, a medium turning tank portion is disposed to have a joining space for joining the first medium after passing through the first passing portion, a distribution space for distribution the first medium from the joining space into the second passing portion, and a pair of first and second communication portions through which the joining space communicates with the distribution space. Furthermore, the first and second communication portions extend in a tank longitudinal direction, the joining space is divided into first and second joining space parts in a tank longitudinal direction, the distribution space is divided into first and second distribution space parts in the tank longitudinal direction at positions corresponding the first and second joining space parts, respectively, the first joining space part communicates with the second distribution space part through the first communication portion, and the second joining space part communicates with the first distribution space part through the second communication portion. Accordingly, the flow of the first medium can be turned in cross in the medium turning tank portion, and medium distribution into the tubes can be improved with a simple structure.

Even in this case, the upstream tank portion can be provided with a first distribution passage for distributing the first medium in the tank longitudinal direction so as to distribute the first medium into the tubes laminated in a direction parallel to the tank longitudinal direction, a second distribution passage for distributing the first medium from the first distribution passage into the tubes in a tank width direction that is perpendicular to both the tube longitudinal direction and the tank longitudinal direction, and a communication passage through which the first medium from the first distribution passage is supplied to the second distribution passage after flowing in the tank longitudinal direction. Accordingly, heat exchanging performance between the first and second mediums can be further improved.

BRIEF DESCRIPTION OF THE DRAWINGS

The above and other objects, features and advantages of the present invention will become more apparent from the following detailed description of preferred embodiments made with reference to the accompanying drawings, in which.

DETAILED DESCRIPTION OF PREFERRED EMBODIMENTS

First Embodiment

Figure 1:
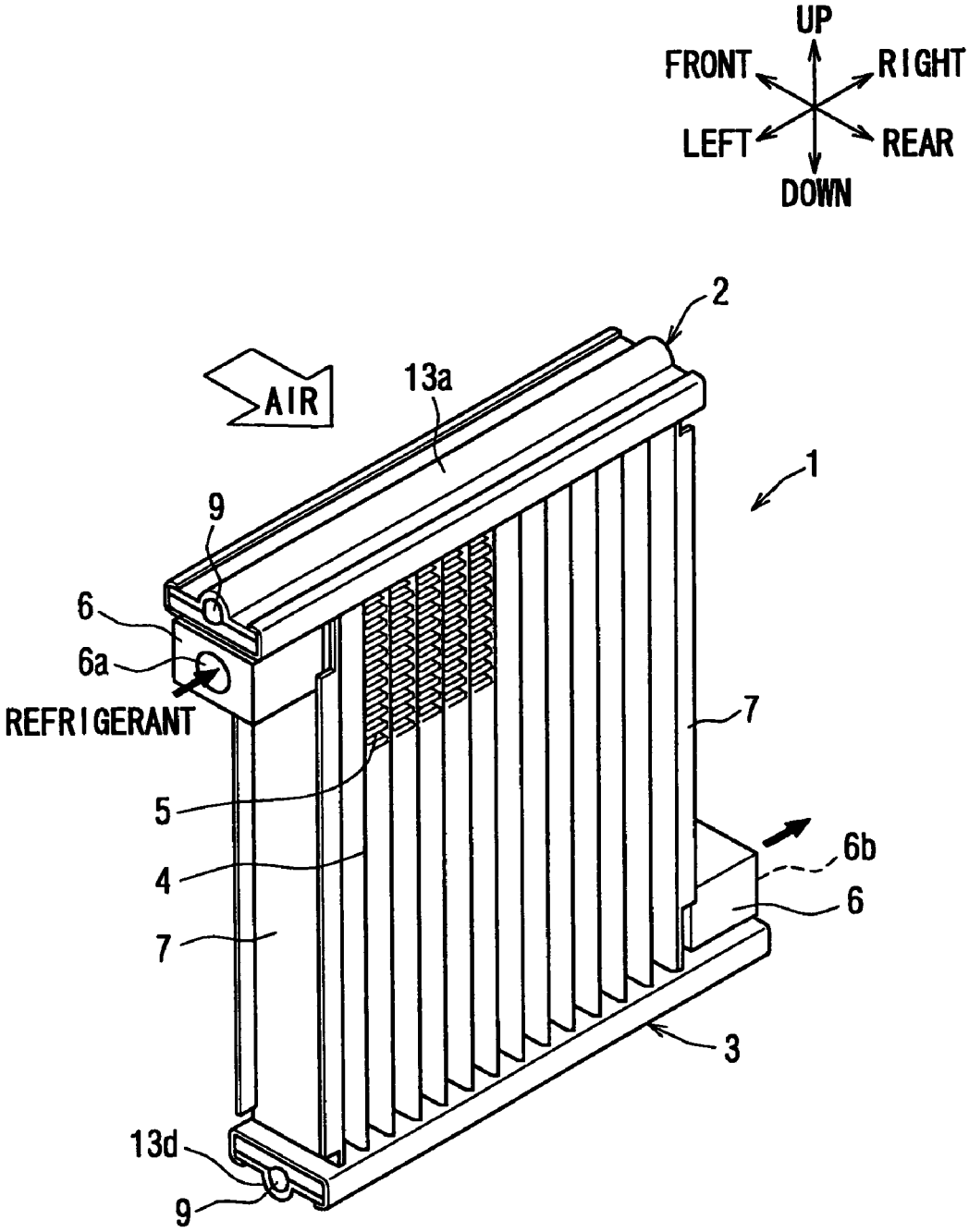
FIG. 1 is a perspective view showing a refrigerant evaporator (heat exchanger) according to a first preferred embodiment of the present invention.

In this embodiment, a heat exchanger of the present invention is typically used as a refrigerant evaporator. FIG. 1 shows a refrigerant evaporator 1 of the first embodiment, in a state where the refrigerant evaporator 1 is actually used in a refrigerant cycle system. In this example shown in FIG. 1, the refrigerant evaporator 1 is arranged as shown in FIG. 1, in the front-rear direction, the right-left direction and the up-down direction (vertical direction). Here, the front-rear direction corresponds to a tank width direction, the right-left direction corresponds to a tank longitudinal direction, and the up-down direction corresponds to a tube longitudinal direction. However, the using arrangement of the refrigerant evaporator 1 can be suitably changed.

The refrigerant evaporator 1 can be suitably used for a super-critical refrigerant cycle using CO2, for example. In the super-critical refrigerant cycle, the pressure of high-pressure side refrigerant becomes equal to or higher than the critical pressure of the refrigerant. The high-pressure side refrigerant is decompressed in a decompression unit such as an expansion valve, and flows into the refrigerant evaporator 1. The refrigerant flowing into the refrigerant evaporator 1 is evaporated in the refrigerant evaporator 1, and gas refrigerant flows out of the refrigerant evaporator 1 to a downstream refrigerant side.

The refrigerant evaporator 1 is a heat exchanger including an upstream tank portion (e.g., upper tank portion) 2, a downstream tank portion (e.g., lower tank portion) 3, and a core portion between the upstream tank portion 2 and the downstream tank portion 3. The core portion includes a plurality of heat-exchange tubes 4 elongated in the vertical direction (up-down direction), and corrugated fins 5 arranged between adjacent tubes 4. The tubes 4 are laminated (stacked) in the right-left direction (laminating direction), as shown in FIG. 1.

The refrigerant evaporator 1 is a whole-pass (one-pass) type in which refrigerant flows in one way in the tubes 4 between the upstream tank portion 2 and the downstream tank portion 3.

A joint block 6 having a refrigerant introduction portion 6*a* is attached to the upstream tank portion 2, and a joint block 6 having a refrigerant discharge portion 6*b* is attached to the downstream tank portion 3, as shown in FIG. 1. Therefore, refrigerant flowing from the refrigerant introduction portion 6*a* of the joint block 6 is distributed into the tubes 4 of the core portion through the upstream tank portion 2, is joined to the downstream tank portion 3, and is discharged from the refrigerant discharge portion 6*b* of the joint block 6.

Two side plates 7 are arranged in the core portion at two sides in the laminating direction of the heat exchange tubes 4 and the corrugated fins 5 (heat exchange fins) to hold and support the two sides of the core portion. The upstream tank portion 2 is constructed with a header plate 10, a first space forming plate 15, a partition plate 12, a second space forming plate 11 and a tank header plate 13. By stacking the header plate 10, the first space forming plate 15, the partition plate 12, the second space forming plate 11 and the tank header plate 13 on a temporarily assembled core portion, the upstream tank portion 2 is formed.

The header plate 10 is formed by pressing a plate material. The header plate 10 has the multiple tube holes 10*a* in which the heat-exchange tubes 4 are inserted and connected, and the refrigerant flow hole 6*c* in which a connection boss portion 6*d* of the joint block 6 is inserted to be connected. Fastening portions 10*b* are provided in the header plate 10 to protrude upwardly so as to fasten the upstream tank portion 2 after the header plate 10, the first space forming plate 15, the partition plate 12, the second space forming plate 11 and the tank header plate 13 are stacked. The refrigerant flow hole 6*c* is also provided in each of the first and second space forming plates 11, 15 and the partition plate 12 at a position corresponding to the connection boss portion 6*d*. Therefore, the refrigerant introduction portion 6*a* of the joint block 6 communicates with a refrigerant distribution passage 13*a* of the header tank plate 13 through the refrigerant flow hole 6*c*.

Figure 3A:
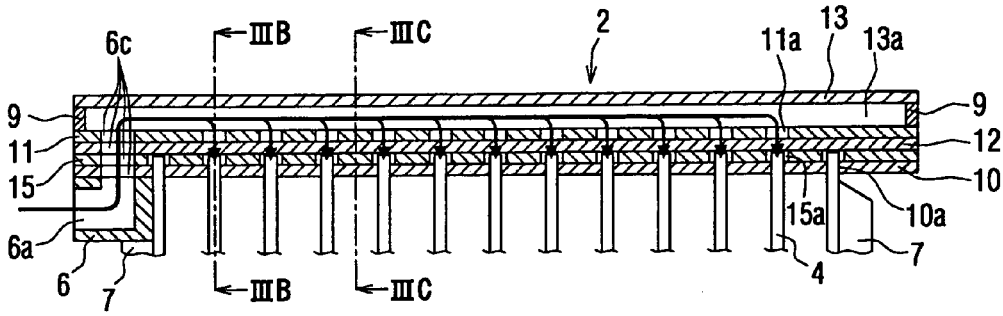
FIG. 3A is a sectional view when taken along a tank longitudinal direction at a center portion of the upstream tank portion in the refrigerant evaporator of FIG. 1.
Figure 3B:
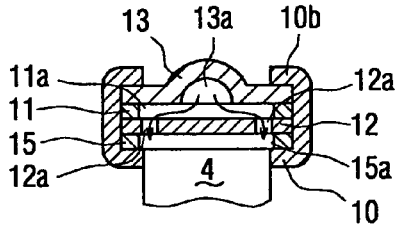
FIG. 3B is a cross-sectional view taken along line IIIB-IIIB in FIG. 3A.

Holes are opened in plate materials by pressing, so that the refrigerant flow hole 6*c* and space holes 11*a*, 15*a* are formed in the first and second space forming plates 11, 15. The space holes 11*a*, 15*a* are arranged in the first and second space forming plates 11, 15 at positions corresponding to the heat exchange tubes 4. The space holes 15*a* are used for distributing refrigerant in the first space forming plate 15. The space holes 11*a* of the second space forming plate 11 are used as communication passages (11) in a tank width direction perpendicular to the longitudinal direction of the upstream tank portion 2. The partition plate 12 is also provided with communication holes 12*a*, in addition to the refrigerant flow hole 6*c*. A partition portion is provided in a middle area of the partition plate 12 to partition the refrigerant distribution space (15*a*) of the first space forming plate 15 and the communication passage (11*a*) of the second space forming plate 11. The refrigerant distribution space (15*a*) and the communication passage (11*a*) of the first and second space forming plates 11, 15 communicate with each other through communication holes 12*a* in the partition plate 12, as shown in FIG. 3B. The communication holes 12*a* form refrigerant distribution passages (12*a*) at two sides in the tank width direction.

The tank header plate 13 is formed by pressing, to have the refrigerant distribution passage 13*a* extending in the tank longitudinal direction at a center area in the tank plate width direction.

The downstream tank portion 3 can have a tank structure without having a partition plate 12. As shown in FIG. 1, a refrigerant join space and a refrigerant join passage 13*d* are formed in the downstream tank portion 3. The refrigerant join passage 13*d* extends in the downstream tank portion 3 in the tank longitudinal direction (i.e., the tube-laminating direction in the core). Two ends of the refrigerant distribution passage 13*a* and two ends of the refrigerant join passage 13*d* are covered by caps 9, respectively. All parts of the upstream tank portion 2 or the downstream tank portion 3 are formed from aluminum plates clad with a brazing material for bonding. For example, all the parts of the upstream tank portion 2 are temporarily fixed by the fastening portion 10*b* of the header plate 10, and are integrally joined to each other by brazing in a furnace.

Figure 3C:
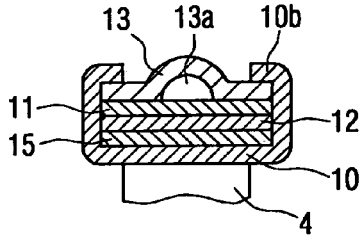
FIG. 3C is a cross-sectional view taken along line IIIC-IIIC in FIG. 3A.

Next, a refrigerant flow in the upstream tank portion 2 will be described. FIG. 3A is a sectional view taken along the tank longitudinal direction at a center portion in the tank width direction. FIG. 3B is a cross-sectional view taken along line IIIB-IIIB in FIG. 3A, and FIG. 3C is a cross-sectional view taken along line IIIC-IIIC in FIG. 3A. Refrigerant flowing into the refrigerant introduction portion 6*a* flows through the refrigerant distribution passage 13*a* through the refrigerant flow hole 6*c*. Because the refrigerant distribution passage 13*a* extends in the tank longitudinal direction (i.e., tube-laminating direction in the core portion), refrigerant flows in the tank longitudinal direction within the refrigerant distribution passage 13*a*. While refrigerant flows in the refrigerant distribution passage 13*a*, the refrigerant is distributed to the space holes 11*a* (communication passages) toward two sides in the tank width direction, at positions corresponding to the heat exchange tubes 4.

As shown in FIG. 3B, the refrigerant approximately horizontally flows in the communication passages (11*a*) toward the two sides in the tank width direction, and flows into the refrigerant distribution spaces (15*a*) of the first space forming plate 15 through the refrigerant distribution passage (12*a*). Then, the refrigerant flows into all the heat exchange tubes 4 from the refrigerant distribution spaces (15*a*).

In this embodiment, the upstream tank portion 2 includes the refrigerant distribution passage 13*a* which extends in the tube stacking direction (tank longitudinal direction) to distribute the refrigerant into the heat exchange tubes 4. Further, the upstream tank portion 2 includes the refrigerant distribution passages 12*a* for distributing the refrigerant supplied from the refrigerant distribution passage 13*a* toward the two sides in the tank width direction (tube width direction). Furthermore, the communication passages (11*a*) are provided between the refrigerant distribution passage 13*a* and the refrigerant distribution passage (12*a*). Therefore, refrigerant supplied from the refrigerant distribution passage 13*a* flows into the refrigerant distribution passage (12*a*) at the two sides of the tank width direction, after flowing through the communication passage (11*a*) toward the two sides in the tank width direction.

Accordingly, the refrigerant in the refrigerant distribution passage 13*a* is not directly distributed to the tubes 4 at a lower side by its weight. That is, the refrigerant in the refrigerant distribution passage 13 is supplied to the refrigerant distribution space (15*a*) after flowing through the communication passage (11*a*) in tank width directions (horizontal directions) that is approximately perpendicular to the main flow direction of the refrigerant flowing in the refrigerant distribution passage 13*a*. Thus, even when refrigerant flows into the refrigerant evaporator 1 from an upper side, the refrigerant can be uniformly distributed to the tubes 4 of the core portion.

Even when the refrigerant flows through the heat exchange tubes 4 of the core portion in one way (whole-pass type) downwardly from the upstream tank portion 2, the refrigerant can be uniformly distributed into the tubes 4 in the tube-laminating direction (tank longitudinal direction). Therefore, a uniform temperature distribution can be obtained in the whole-pass type evaporator in which refrigerant flows through all the tubes 4 in one way. Further, because refrigerant flows through the tubes 4 in one way from the upstream tank portion 2 to the downstream tank portion 3, refrigerant pressure loss can be reduced.

In this embodiment, even when the length of the core portion (the heat exchange tubes) is changed, the core portion can be easily connected to the upstream tank portion 2 without changing the connection structure therebetween. Therefore, the upstream tank portion 2 can be easily changed with a conventional one in a refrigerant cycle. Furthermore, because the refrigerant inlet is provided at an upper side in the refrigerant evaporator 1, the refrigerant evaporator 1 can be easily mounted on a vehicle.

Further, the refrigerant distribution passage 13*a* in the tank longitudinal direction, the refrigerant distribution passage (12*a*) in the tank width direction and the communication passage (11*a*) between the distribution passages 13*a* and (12*a*) are formed in the upstream tank portion 2 by stacking the plates 15, 12, 11 and 13 on the header plate 10. In this embodiment, the refrigerant distribution passages (12*a*) for distributing refrigerant in the tank width direction are formed by using the space holes 12*a* provided in the partition plate 12, and the communication passages (11*a*) are formed by using the space holes (11*a*) provided in the plate 11. Furthermore, because the refrigerant distribution passages 12*a*, 13*a* and the communication passage 11*a* between the refrigerant distribution passages 12*a*, 13*a* are formed by stacking the plates 13, 11, 12, 15 on the header plate 10, the upstream tank portion 2 can be easily manufactured.

In this embodiment, the refrigerant evaporator 1 includes the multiple flat tubes 4, and the upstream tank portion 2 for distributing refrigerant (first medium) into the multiple flat tubes 4. Further, the upstream tank portion 2 can be located at an upper side relative to the multiple tubes 4. The core portion includes multiple flat tubes 4 that are arranged at an interval to be parallel to each other. That is, the tubes 4 are laminated in a direction parallel to the tank longitudinal direction. Air (second medium) flows outside the flat surfaces of the tubes 4 approximately in a direction perpendicular to the tube longitudinal direction. The fins 5 are arranged between adjacent tubes 4 to increase heat exchange with air.

The upstream tank portion 2 extends in the direction parallel to the tube laminating direction. That is, the tank longitudinal direction corresponds to the tube arrangement direction.

The refrigerant distribution passage 13*a* is provided in the upstream tank portion 2 to extend in the tube arrangement direction. The refrigerant distribution passage 13*a* has a width in the direction perpendicular to the tank longitudinal direction. For example, the width of the refrigerant distribution passage 13*a* is greatly smaller than the width of each tube 4. Therefore, each tube 4 is opened at two sides relative to the refrigerant distribution passage 13*a*, in the tank width direction.

In addition, the upstream tank portion 2 has a refrigerant distribution portion for distributing the refrigerant from the refrigerant distribution passage 13*a* in the tank width direction. Here, the tank width direction corresponds to a major direction in a tube passage cross-section. In this embodiment, the refrigerant distribution portion for distributing the refrigerant from the refrigerant distribution passage 13*a* in the tank width direction is constructed with the communication passage (11*a*) and the refrigerant distribution passages (12*a*). The refrigerant from the refrigerant distribution passage 13*a* flows through the communication passage (11*a*) toward the refrigerant distribution passages (12*a*) at two sides in the tank width direction, and flows into each tube 4 through the refrigerant distribution passages (12*a*).

Because the refrigerant flows through the refrigerant distribution passage 13*a* in the tank longitudinal direction, the refrigerant can be uniformly introduced into all the tubes 4 in the tube laminating direction. Furthermore, the refrigerant from the refrigerant distribution passage 13*a* flows through the communication passage (11*a*) toward the refrigerant distribution passages (12*a*) at the two sides in the tank width direction, the refrigerant from the refrigerant distribution passage 13*a* can be effectively distributed in the tank width direction.

Accordingly, the refrigerant can be distributed into the front and rear two sides in the major direction of each tube 4 in cross-section, while refrigerant flows in the upstream tank portion 2 in the tube arrangement direction (tank longitudinal direction). Thus, the refrigerant flows uniformly in all the tubes 4 arranged in a line.

In the above-described embodiment, the refrigerant from the refrigerant distribution passage 13*a* flows toward two sides in the tank width direction. However, the refrigerant distribution portion for distributing the refrigerant from the distribution passage 13*a* in the tank width direction can be set at one side in the tank width direction, or can be set at two sides in the tank width direction alternatively at positions corresponding to adjacent two tubes 4.

Figure 4A:
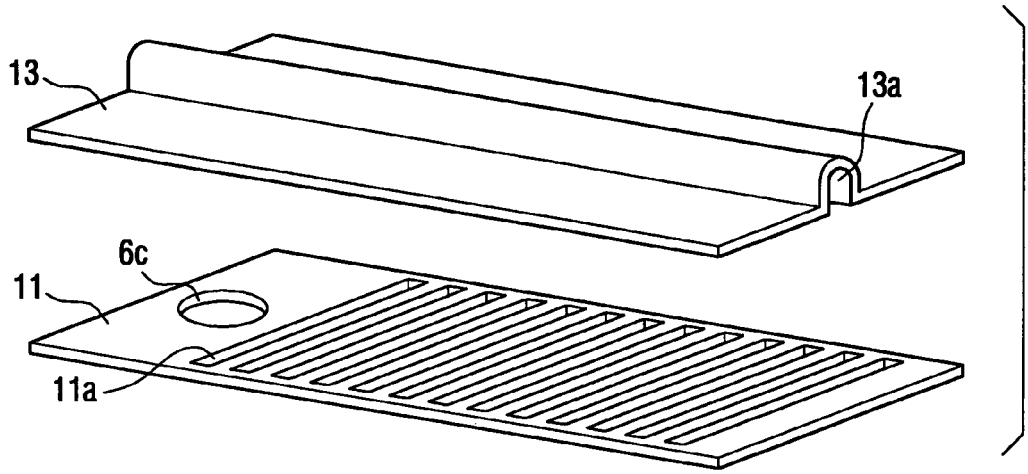
FIG. 4A is a disassembled perspective view showing two plates of the upstream tank portion of the refrigerant refrigerator in FIG. 1.
Figure 4B:
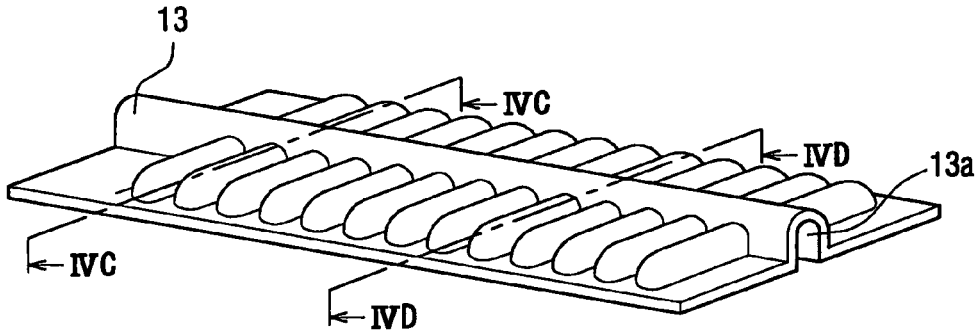
FIG. 4B is a perspective view showing a tank header plate according to a modification of FIG. 4A.
Figure 4C:
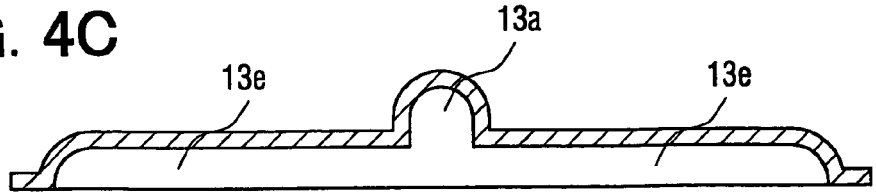
FIG. 4C is a cross-sectional taken along line IVC-IVC in FIG. 4B.
Figure 4D:
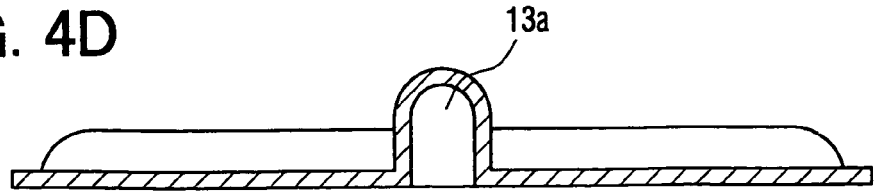
FIG. 4D is a cross-sectional taken along line IVD-IVD in FIG. 4B.

FIG. 4A shows the two plates 13 and 11 of the refrigerant evaporator 1 in the first embodiment. However, as shown in FIG. 4B, a tank header plate 13 can be formed to have a distribution passage 13*a* extending in the tank longitudinal direction, and distribution passages 13*e* extending in a tank width direction perpendicular to the tank longitudinal direction. The distribution passages 13*e* are formed in the header tank plate 13 by protrusions formed in the header tank plate 13 so as to have the functions of the communication passage (11*a*) in FIG. 4A. The distribution passages 13*e* are provided at positions corresponding to the tube insertion holes of the upstream tank portion 2. In this example shown in FIGS. 4B-4D, because the plate 11 is unnecessary, the assembling of the upstream tank portion 2 can be made simple, and the cost of the refrigerant evaporator can be effectively reduced.

Figure 5A:
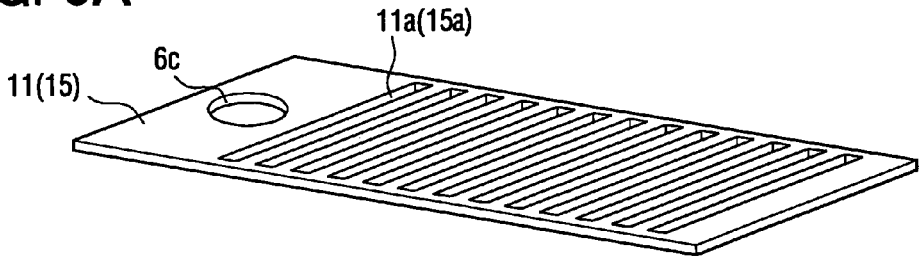
FIG. 5A is a perspective view showing a plate in the upstream tank portion of the refrigerant evaporator in FIG. 1.
Figure 5B:
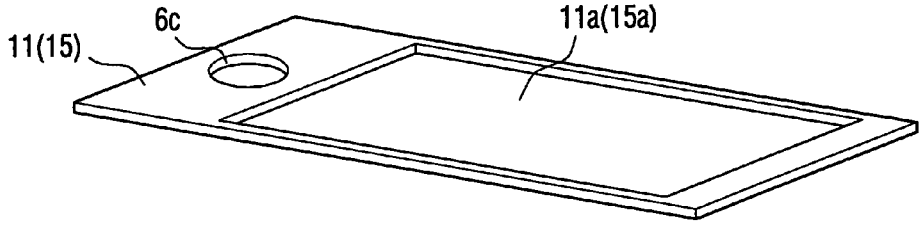
FIG. 5B is a perspective view according to a modification of the plate in FIG. 5A.

In the above-described first embodiment, the first or second space forming plate 11, 15 is formed as shown in FIG. 5A, to have the space holes 11*a*, 15*a* at the positions corresponding to the heat exchange tubes 4. However, the first or second space forming plate 11, 15 can be formed as in a modification shown in FIG. 5B. For example, when R134a is used as the refrigerant, a high pressure resistance is not requested in the refrigerant evaporator 1. When the plates 11, 15 shown in FIG. 5B are used for forming refrigerant passages in the upstream tank portion 2, the cost of the refrigerant evaporator can be decreased because the plates 11, 15 can be easily formed.

Figure 6A:
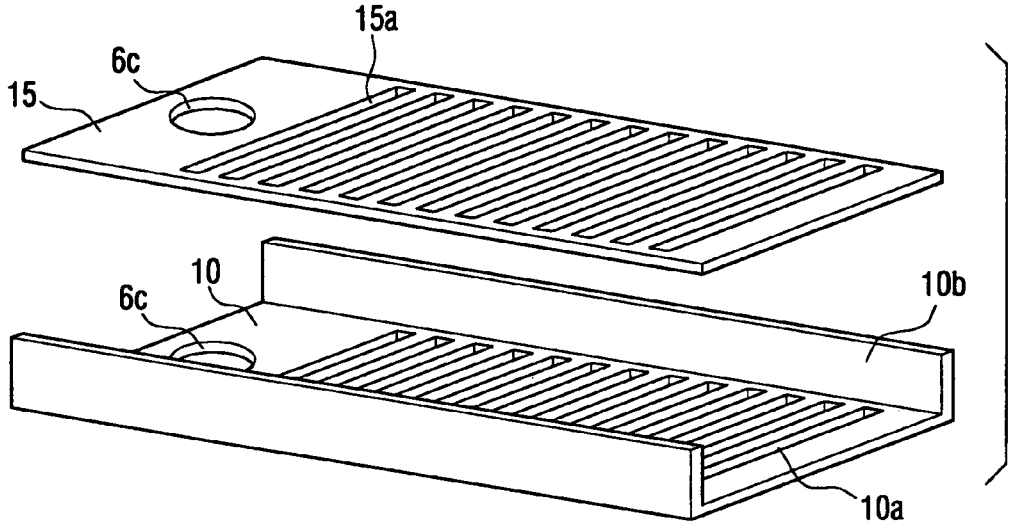
FIG. 6A is a disassembled perspective view showing two plates of the upstream tank portion of the refrigerant refrigerator in FIG. 1.

FIG. 6A shows the first space forming plate 15 and the header plate 10 of the first embodiment. The first space forming plate 15 and the header plate 10 shown in FIG. 6A can be formed integrally as in FIG. 6B. In the modification shown in FIG. 6B, the function of the refrigerant distribution space 15*a* is provided in the header plate 10, and the plate 15 is omitted. For example, protrusion openings 10*c* are provided in the header plate 10 at positions corresponding to the heat exchange tubes 4 so that the header plate 10 has the function of the distribution spaces 15*a* of FIG. 6A. In this case, the weight of the tank portion 2 can be reduced, and the assembling of the tank portion 2 can be made simple.

Figure 2:
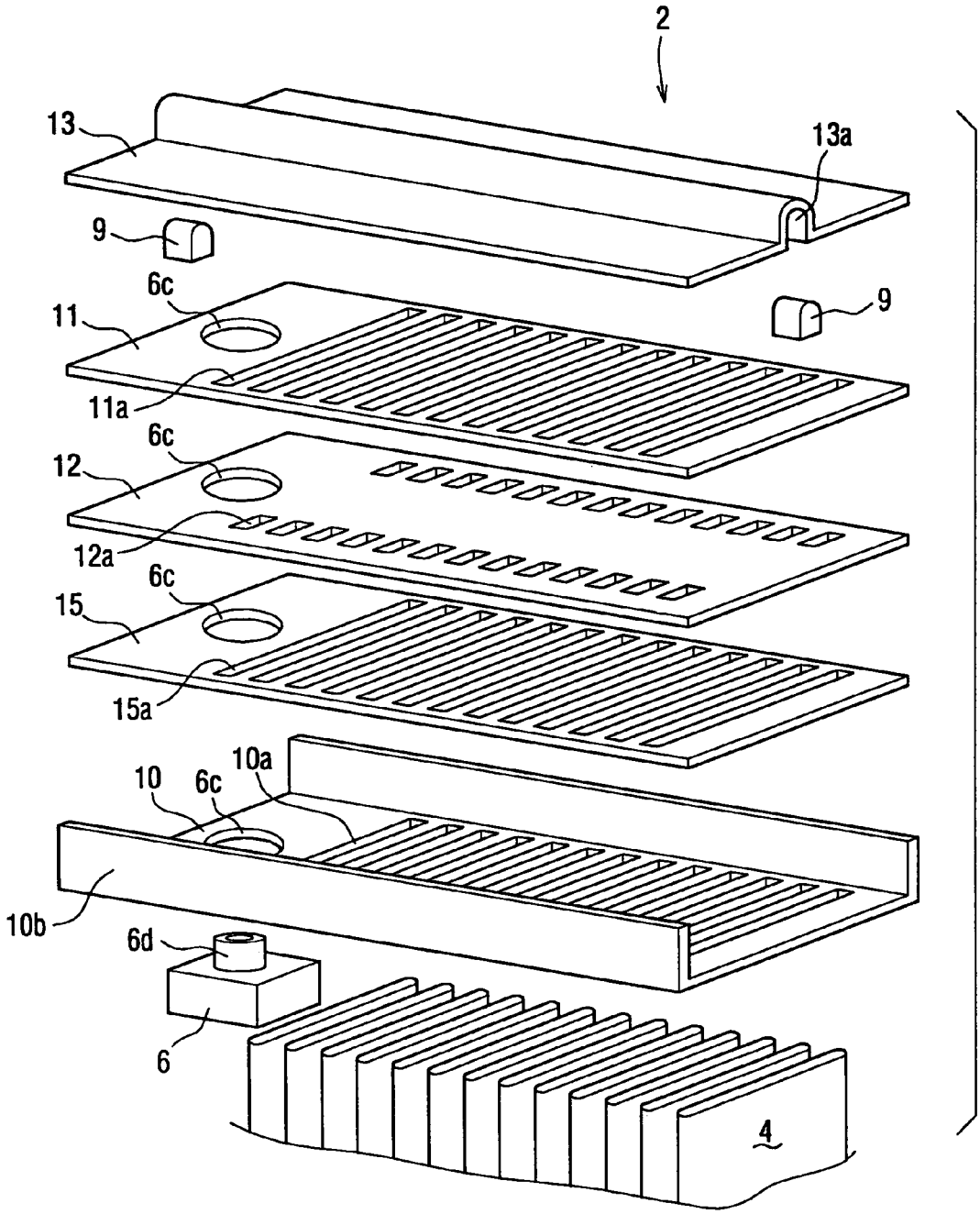
FIG. 2 is a disassembled perspective view showing an upstream tank portion in the refrigerant evaporator of FIG. 1.
Figure 6B:
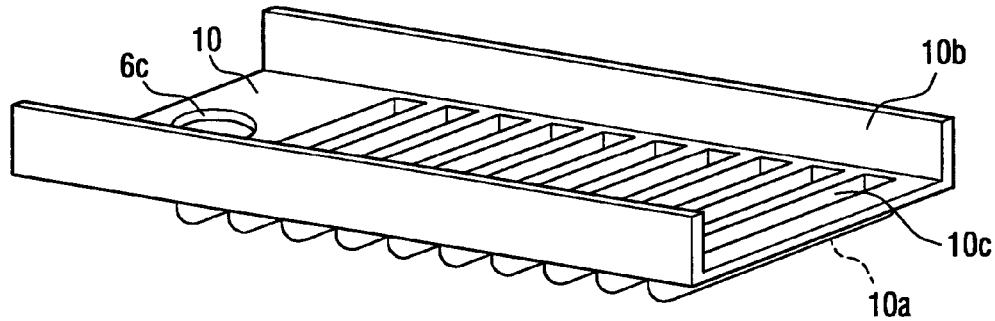
FIG. 6B is a perspective view showing a header plate according to a modification of FIG. 6A.
Figure 13:
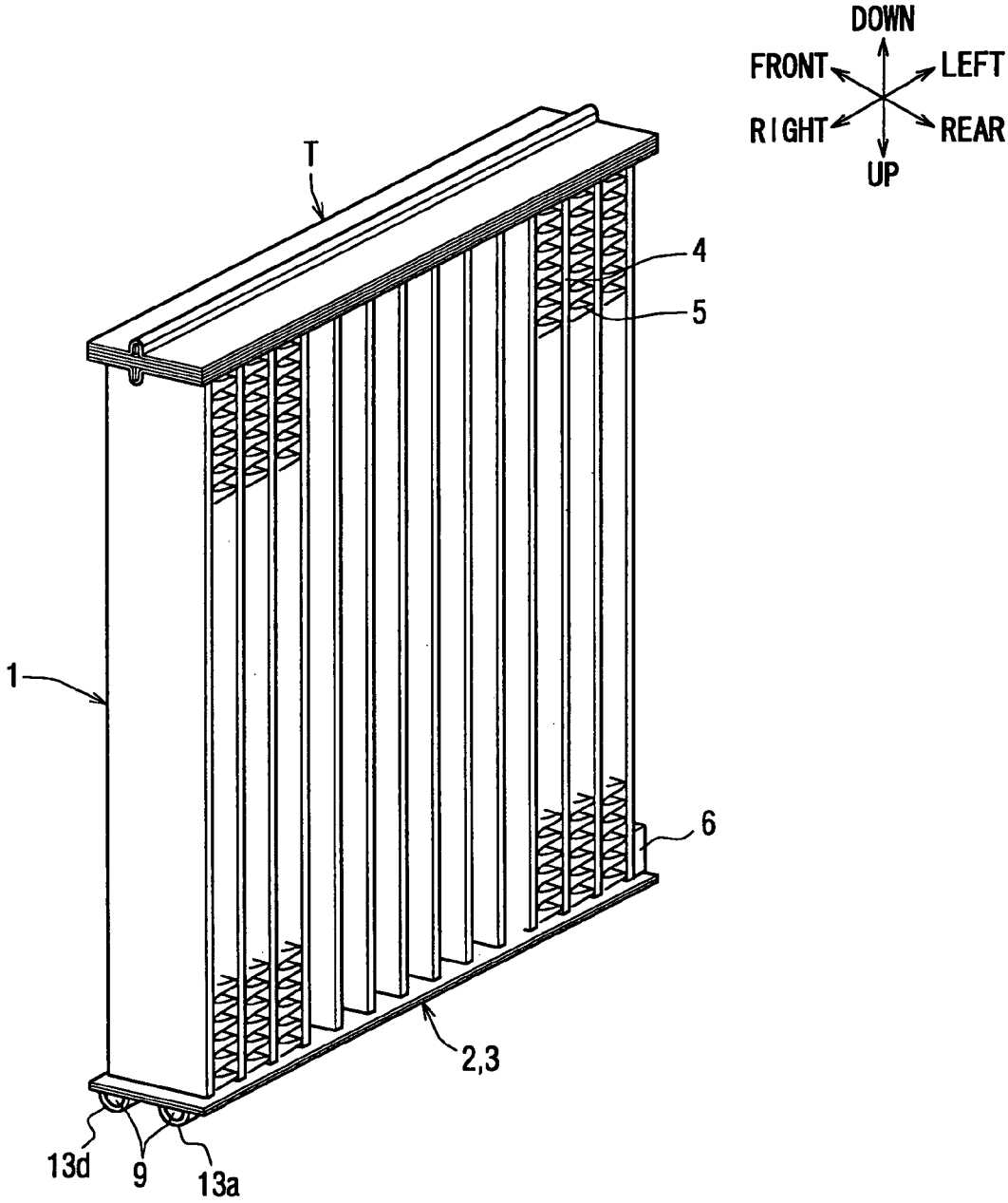
FIG. 13 is a perspective view showing a refrigerant evaporator (heat exchanger) according to a third preferred embodiment of the present invention.

Accordingly, the upstream tank portion 2 can be formed by stacking three plates such as the header plate 10 shown in FIG. 6B, the partition plate 12 shown in FIG. 2 and the header tank plate 13 shown in FIG. 13.

Figure 7:
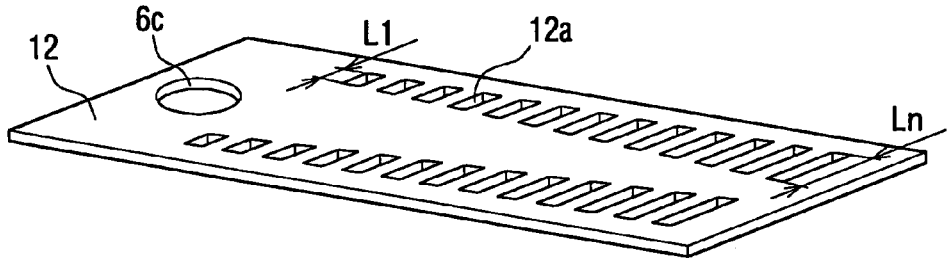
FIG. 7 is a perspective view showing a partition plate according to a modification of the first embodiment.

In the above-described first embodiment, the open areas of the communication holes 12*a* are made equal, as shown in FIG. 2. However, the open areas of the communication holes 12*a* can be changed. FIG. 7 shows a partition plate 12 having communication holes 12*a* according to another modification of the first embodiment. In the example shown in FIG. 7, the open areas of the communication holes 12*a* are made larger gradually from a portion the refrigerant flow hole 6*c*, toward the other end portion, in the tank longitudinal direction. Generally, the pressure loss of the refrigerant distribution passage 13*a* is increased as toward the other end from the refrigerant flow inlet. In this example shown in FIG. 7, because the open areas of the communication holes 12*a* become gradually larger as far from the refrigerant inlet port, the refrigerant distribution in the tubes 4 can be made further uniform.

Further, the communication holes 12*a* can be formed into a shape other than a square shape. For example, the communication holes 12 can be formed into a round shape. In the examples shown in FIGS. 2 and 7, the communication holes 12 are arranged in two lines at positions corresponding to the tubes 4. However, the communication holes 12 can be arranged in one line in the tank longitudinal direction, or at least adjacent two communication holes 12*a* in each line can communicate with each other to form a large opening.

Second Embodiment

Figure 8A:
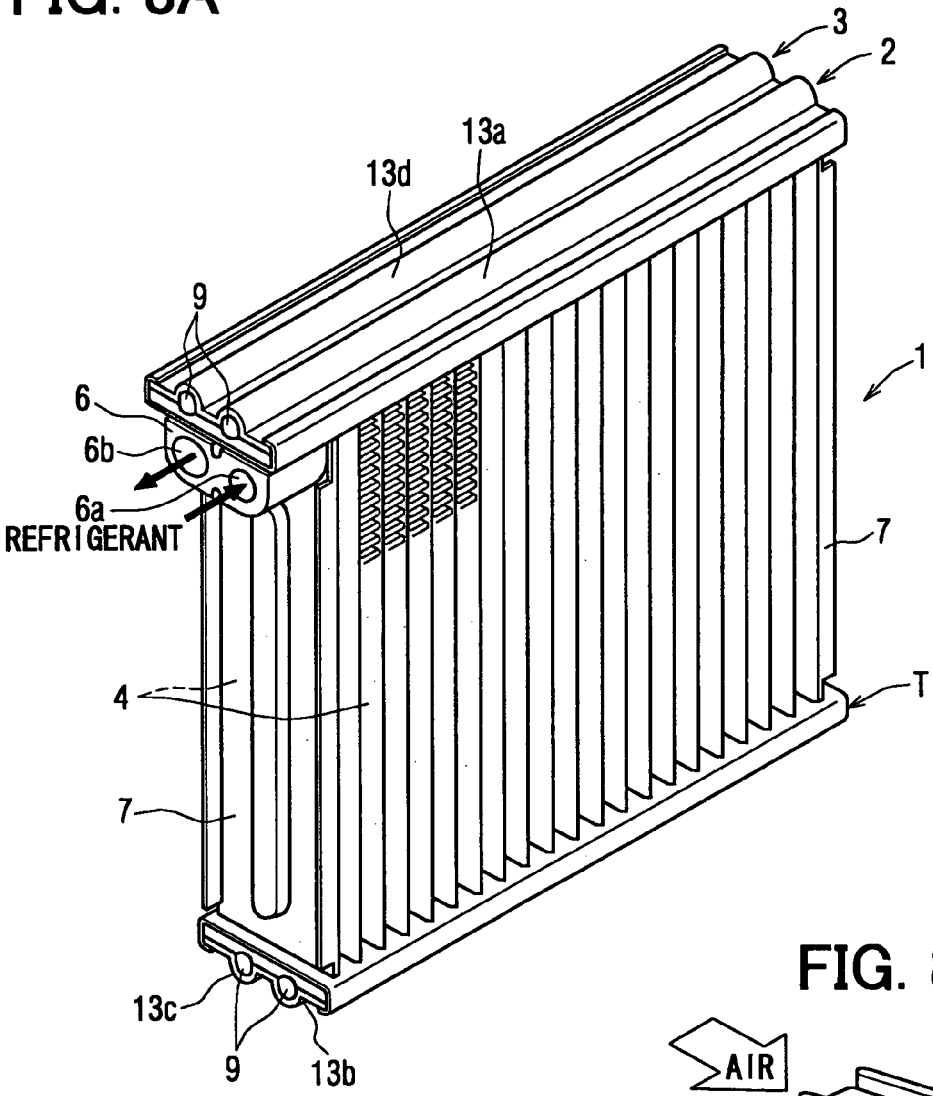
FIG. 8A is a perspective view showing a refrigerant evaporator (heat exchanger) according to a second preferred embodiment of the present invention.
Figure 8B:
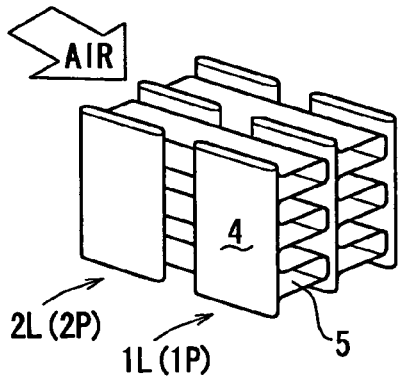
FIG. 8B is an enlarged perspective view showing a part of a core portion of the refrigerant evaporator in FIG. 8A.

FIG. 8A is a perspective view showing a refrigerant evaporator 1 according to the second embodiment, and FIG. 8B is an enlarged perspective view showing a part of a core portion of the refrigerant evaporator 1 in FIG. 8B. In the above-described first embodiment, refrigerant flows in one way in the tube longitudinal direction through all the tubes 4 of the core portion without being U-turned. However, in the second embodiment, the tubes 4 are arranged in two lines in a flow direction of the second medium (e.g., air) so that refrigerant flows through all the tubes 4 on one line and flows through all the tubes 4 on the other line after being U-turned.

In the second embodiment, the refrigerant evaporator 1 includes an upper tank portion 2, 3, a refrigerant turning portion T and the core portion between the upper tank portion 2, 3 and the refrigerant turning portion T. The upper tank portion 2, 3 includes an upstream tank portion 2 and a downstream tank portion 3. The upstream and downstream tank portions 2 and 3 are integrated to form the upper tank portion. The refrigerant turning portion T is used as a lower tank portion in this example of FIG. 8A.

The tubes 4 are arranged to have a first tube line 1L for forming a first refrigerant pass portion 1P and a second tube line 2L for forming a second refrigerant pass portion 2P. The upstream tank portion 2 is connected to the first refrigerant pass portion 1P of the tubes 4, and the downstream tank portion 3 is connected to the second refrigerant pass portion 2P of the tubes 4, as shown in FIG. 8A. Therefore, refrigerant flows through the first refrigerant pass portion 1P, and flows through the second refrigerant pass portion 2P after being U-turned in the refrigerant turning portion T.

In each of the first and second tube lines 1L, 2L, corrugated fins 5 are arranged between adjacent tubes 4. In the example shown in FIGS. 8A and 8B, the first refrigerant pass portion 1P is arranged at a downstream air side in the core portion, and the second refrigerant pass portion 2P is arranged at an upstream air side in the core portion, so that heat exchanging performance between the refrigerant and air can be improved.

Figure 9:
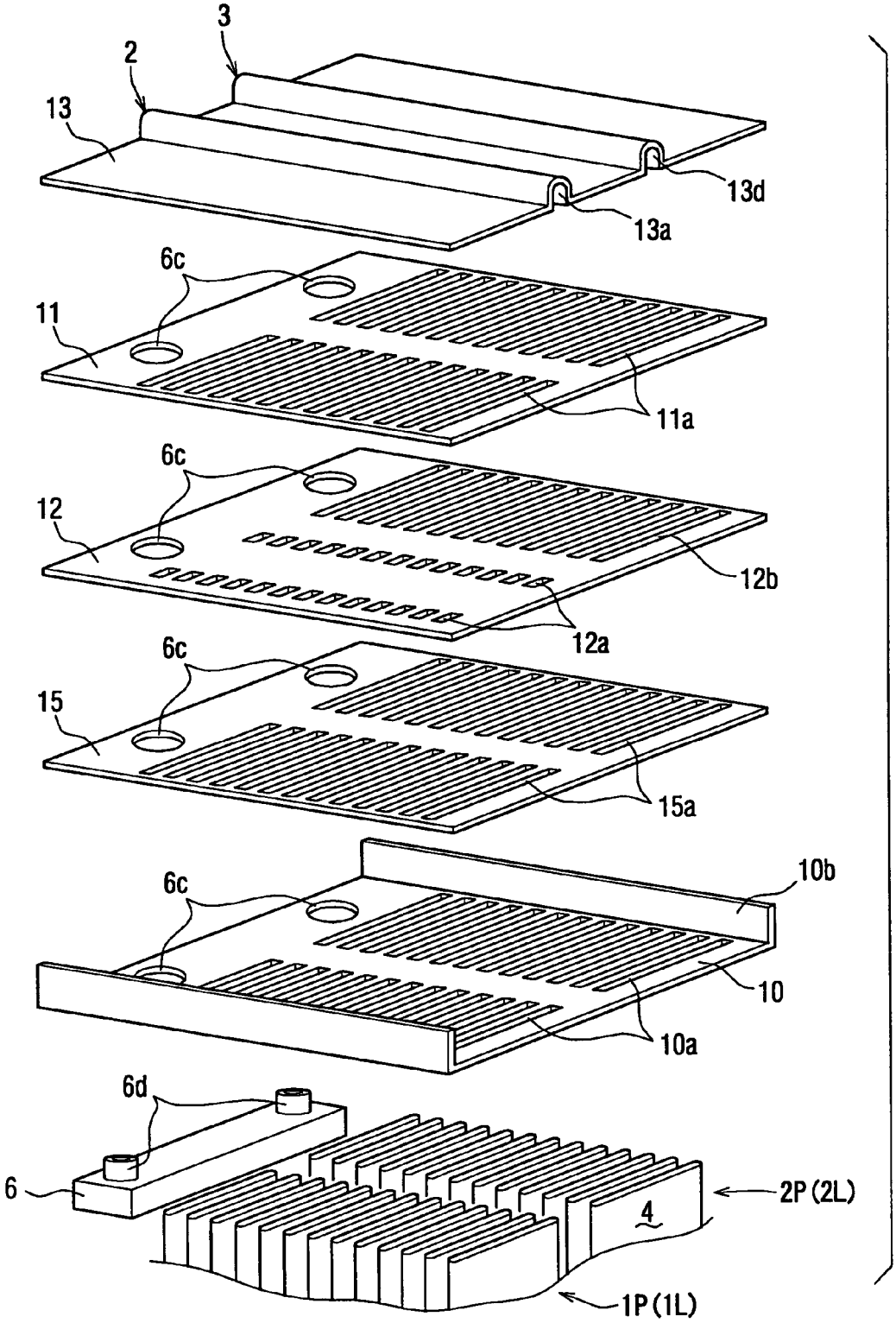
FIG. 9 is a disassembled perspective view showing an upper tank portion in the refrigerant evaporator of FIG. 8A.

As shown in FIG. 9, the upper tank portion 2, 3 is forming by stacking a header plate 10, a first space forming plate 15, a partition plate 12, a second space forming plate 11 and a header tank plate 13, on the core portion. The header plate 10 has tube holes 10*a* which are arranged in two lines so that the heat exchange tubes 4 are inserted into and connected to the tube holes 10*a*. Furthermore, the header plate 10 has two refrigerant flow holes 6*c* into which connection boss portions 6*d* of a joint block 6 are inserted to be connected. The header plate 10 can be formed by pressing.

Fastening portions 10*b* are provided in the header plate 10 to protrude upwardly so as to fasten the upper tank portion 2, 3 after the header plate 10, the first space forming plate 15, the partition plate 12, the second space forming plate 11 and the tank header plate 13 are laminated. The refrigerant flow hole 6*c* is also provided in each of the first and second space forming plates 11, 15 and the partition plate 12 at a position corresponding to the connection boss portion 6*d*. Therefore, a refrigerant introduction portion 6*a* of the joint block 6 communicates with a refrigerant distribution passage 13*a* of the header tank plate 13. Similarly, a refrigerant discharge portion 6*b* of the joint block 6 communicates with a refrigerant joining passage 13*d* of the header tank plate 13.

As shown in FIG. 9, both the refrigerant distribution passage 13*a* and the refrigerant joining passage 13*d* are extended in the tank longitudinal direction.

Holes are opened in plate materials by pressing, so that the refrigerant flow hole 6*c* and space holes 11*a*, 15*a* are formed in two lines in the first and second space forming plates 11, 15. The space holes 11*a*, 15*a* are arranged in the first and second space forming plates 11, 15 at positions corresponding to the heat exchange tubes 4. The space holes 15*a* for the upstream tank portion 2 are used as a distribution space for distributing refrigerant in the first space forming plate 15. The space holes 11*a* of the second space forming plate 11 are used as communication passages (11*a*) in the upstream tank portion 2. Through the communication passages (11*a*), refrigerant can flow in the second space forming plate 11 in a tank width direction perpendicular to the tank longitudinal direction, in the upstream tank portion 2. The partition plate 12 is provided with communication holes 12*a* for the upstream tank portion 2, space holes 12*b* for forming a communication passage of the downstream tank portion 3, and the refrigerant flow holes 6*c*. The communication holes 12*a* are used as refrigerant distribution passages (12*a*) similarly to the above-described first embodiment. A partition portion is provided between two lines of the communication holes 12*a* of the partition plate 12 in the upstream tank portion 2. The communication holes 12*a*, the space holes 12*b* and the refrigerant flow holes 6*c* can be formed in the plate 12 by pressing.

The tank header plate 13 can be formed by pressing to have the refrigerant distribution passage 13*a* used for the upstream tank portion 2, and the refrigerant joining passage 13*d* used for the downstream tank portion 3. Each of the refrigerant distribution passage 13*a* and the refrigerant joining passage 13*d* extends in a tank longitudinal direction that corresponds to the tube laminating direction.

The refrigerant turning portion T can be formed by laminating plates, similarly to the above-described first embodiment. The inner plates of the refrigerant turning portion T are formed to have communication passages corresponding to the two lines 1L, 2L of the tubes 4. That is, in the refrigerant turning portion T, there is provided with a refrigerant joining space corresponding to the tubes 4 on the first line 1L, the refrigerant joining passage 13*b* extending in a tank longitudinal direction, a refrigerant distribution space corresponding to the tubes 4 on the second line 2L, the refrigerant distribution passage 13*c* extending in a tank longitudinal direction, and a communication passage for communicating the refrigerant joining passage 13*b* and the refrigerant distribution passage 13*c*.

The ends of the refrigerant distribution passages 13*a*, 13*c* and the refrigerant joining passages 13*b*, 13*d* are closed by caps 9. After the upper tank portion 2, 3, the refrigerant turning portion T and the core portion are temporarily assembled, the assembled member is integrally brazed in a furnace.

Figure 10:
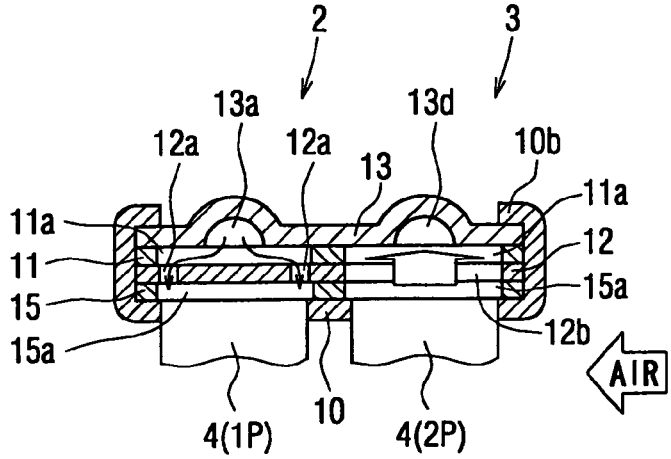
FIG. 10 is a cross-sectional view of the upper tank portion taken along a tank width direction in the refrigerant evaporator of FIG. 8A.

Next, a refrigerant flow in the refrigerant evaporator 1 according to the second embodiment will be described. FIG. 10 is a cross-sectional view of the upper tank portion 2, 3, taken along a tank width direction perpendicular to the tank longitudinal direction.

Refrigerant supplied from the refrigerant introduction portion 6*a* flows into the refrigerant distribution passage 13*a* through the refrigerant flow hole 6*c* in each plate. The refrigerant supplied into the refrigerant distribution passage 13*a* flows through the refrigerant distribution passage 13*a* in the tank longitudinal direction. While the refrigerant flows through the refrigerant distribution passage 13*a*, the refrigerant is distributed to the communication passage (11*a*) of the second space forming plate 11, corresponding to the tubes 4 of the first refrigerant passing portion 1P.

The refrigerant flows into the tubes 4 of the first refrigerant passing portion 1P through the refrigerant distribution passages (12*a*) and the refrigerant distribution passages (15*a*) in the first refrigerant passing portion 1P.

The refrigerant flowing through the tubes 4 of the first refrigerant passing portion 1P is joined to the refrigerant joining passage 13*b* through the refrigerant joining space in the refrigerant turning portion T, and is moved to the refrigerant distribution passage 13*c* through the communication passage of the refrigerant turning portion T. While the refrigerant flows through the refrigerant joining passage 13*c*, the refrigerant in the refrigerant joining passage 13*c* is distributed to the refrigerant distribution space (not shown) in the refrigerant turning portion T, and flows into the tubes 4 in the second refrigerant passing portion 2P.

The refrigerant passing through the tubes 4 of the second refrigerant passing portion 2P flows into the refrigerant joining passage 13*d* through passages (15*a*, 12*b*, 11*a*) in the downstream tank portion 3. Then, the refrigerant flows out from the refrigerant discharge portion 6*b* through the refrigerant flow holes 6*c*.

In the second embodiment, the first tube line 1L for forming the first refrigerant passing portion 1P and the second tube line 2L for forming the second refrigerant passing portion 2P are arranged in the air flow direction. Furthermore, the upstream tank portion 2 communicates with the tubes 4 of the first refrigerant passing portion 1P, and the downstream tank portion 3 communicates with the tubes 4 of the second refrigerant passing portion 2P, at one end of the core portion. At the other end of the core portion, the tubes 4 of the first and second refrigerant passing portions 1P, 2P communicate with the refrigerant turning portion T.

In the example of the second embodiment, the refrigerant stream is U-turned in the refrigerant evaporator 1 by one time. However, the refrigerant evaporator 1 can be constructed to be turned by two times or more. In the second embodiment, the other parts are similar to those of the above-described first embodiment.

Similarly to the above-described first embodiment, the example structure shown in FIG. 4B can be used for refrigerant passages of the upstream tank portion 2 and the downstream tank portion 3 in the second embodiment. Further, the example shown in FIG. 5B can be used for refrigerant passages of the plates 11, 15 in the second embodiment. The example shown in FIG. 6B can be used for refrigerant passages in each refrigerant passing portion of the plate 10 in the second embodiment. In addition, the example shown in FIG. 7 can be used for the communication holes 12*a* of the plate 12 in the second embodiment.

Figure 11:
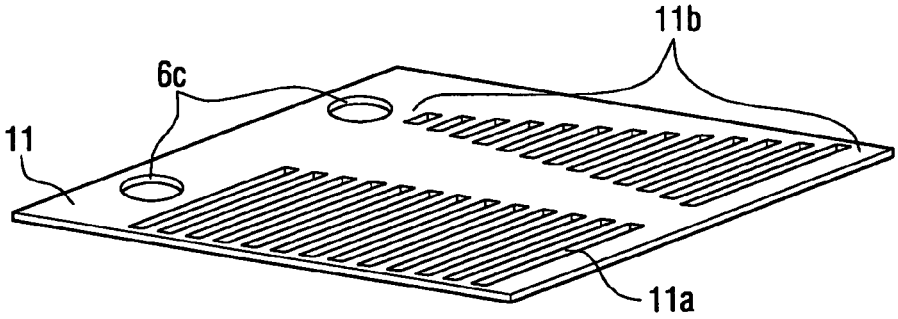
FIG. 11 is a perspective view showing a plate according to a modification of the second embodiment.
Figure 12:
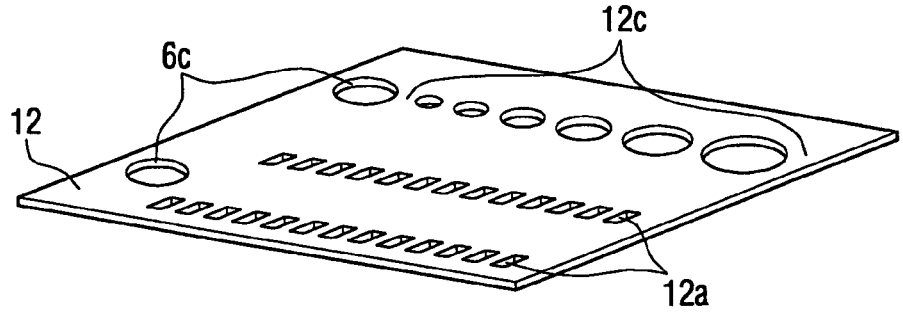
FIG. 12 is a perspective view showing a plate according to another modification of the second embodiment.

As an example, the plate 11 of the second embodiment can be formed into the shape shown in FIG. 11, or the plate 12 of the second embodiment can be formed into the shape shown in FIG. 12. In the example shown in FIG. 11, space holes 11*b* of the plate 11 in the downstream tank portion 3 are set to become gradually smaller toward the refrigerant discharge end side in the tank longitudinal direction. That is, the open areas of the space holes 11*b* become gradually larger from the end side where the refrigerant is discharged, to the other end side, in the tank longitudinal direction. When the space holes 11*b* are provided in the plate 11 for the downstream tank portion 3, it can restrict the refrigerant from being biased in the tubes 4 of the second refrigerant passing portion 2P. That is, the space holes 11*b* can be used as refrigerant-bias restricting means.

In the example shown in FIG. 12, space holes 12*c* are used instead of the space holes 12*b* of the partition plate 12. In the example shown in FIG. 12, the space holes 12*c* of the plate 12 in the downstream tank portion 3 are set to become gradually smaller toward the refrigerant discharge end side in the tank longitudinal direction. That is, the open areas of the space holes 12*c* become gradually larger from the end side where the refrigerant is discharged, to the other end side, in the tank longitudinal direction. When the space holes 12*c* are provided in the plate 12 for the downstream tank portion 3, it can restrict the refrigerant from being biased in the tubes 4 of the second refrigerant passing portion 2P. That is, the space holes 12*c* can be used as refrigerant-bias restricting means.

When the total area of the space holes 11*b* or the space holes 12*c* is made larger than the total passage-sectional area of the tubes 4, the pressure loss can be made small. Furthermore, the shapes of the holes 11*b*, 12*c* can be suitably changed, and the holes 11*b* or the holes 12*c* can be formed by an integrally connected hole without being partitioned in the tank longitudinal direction.

Third Embodiment

Figure 14:
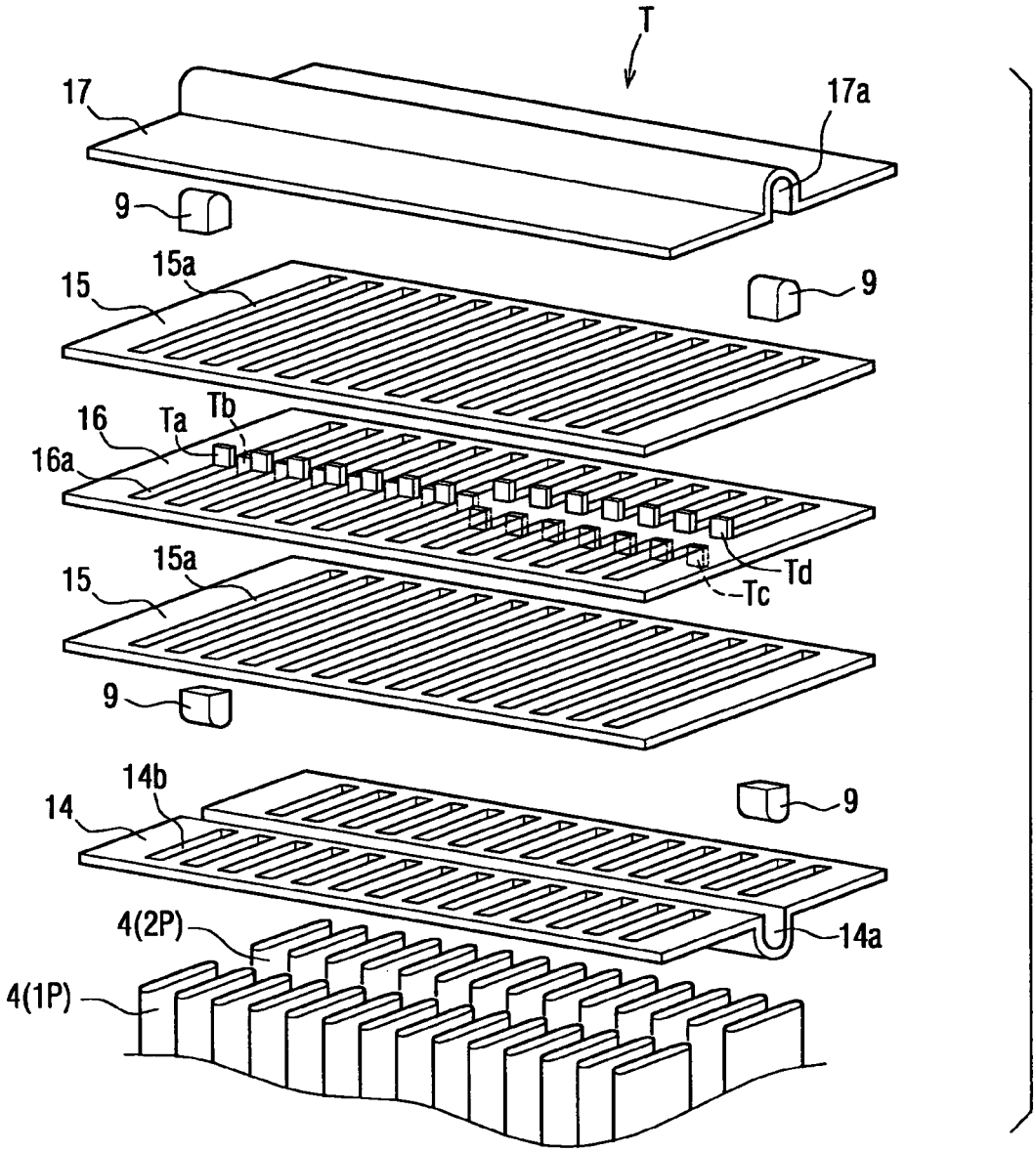
FIG. 14 is a disassembled perspective view showing a refrigerant tank portion in the refrigerant evaporator in FIG. 13.

FIG. 13 is a perspective view showing a refrigerant evaporator 1 according to the third embodiment, and FIG. 14 is a disassembled perspective view showing a refrigerant turning portion T of the refrigerant evaporator 1 in FIG. 13. The refrigerant evaporator 1 shown in FIG. 13 is generally used in a position indicated by arrows in the up-down direction, the right-left direction and the front-rear direction. For example, a refrigerant turning portion T in FIG. 13 is used as the bottom of the evaporator 1, and upstream and downstream tank portions 2, 3 in FIG. 13 are used as the top of the refrigerant evaporator 1.

In this embodiment, the structures of the upstream and downstream tank portions 2, 3 are similar to those of the above-described second embodiment. The refrigerant turning portion T is formed by stacking a header plate 14, a first space forming plate 15, a crossing plate 16, a second space forming plate 15' and a tank header plate 17, on a temporarily assembled core portion. The header tank plate 17 is formed by pressing a plate material, to have a communication portion 17*a* extending in a tank longitudinal direction at a center area in a tank width direction.

The header plate 14 is also formed by pressing a plate material, to have a communication portion 14*a* extending in the tank longitudinal direction at a center area in the tank width direction. Furthermore, the header plate 14 has tube insertion holes 14*b* at two sides of the communication portion 14*a* in the tank width direction, so that the tubes 4 are inserted into the tube insertion holes 14*b*. Therefore, in the third embodiment, refrigerant communicates between the first refrigerant passing portion 1P and the second refrigerant passing portion 2P, through a pair of the communication portions 14*a*, 17*a*. The communication portions 14*a*, 17*a* extend in the tank longitudinal direction.

Figure 15A:
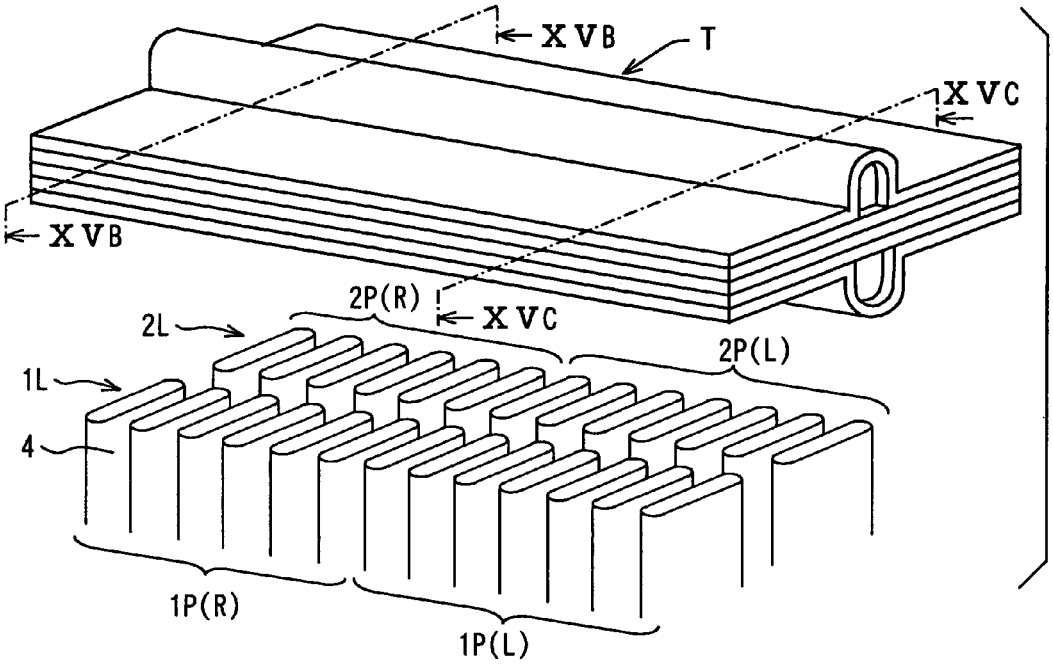
FIG. 15A is a perspective view of a refrigerant turning portion (lower tank portion) in the refrigerant evaporator of FIG. 13.
Figure 15B:
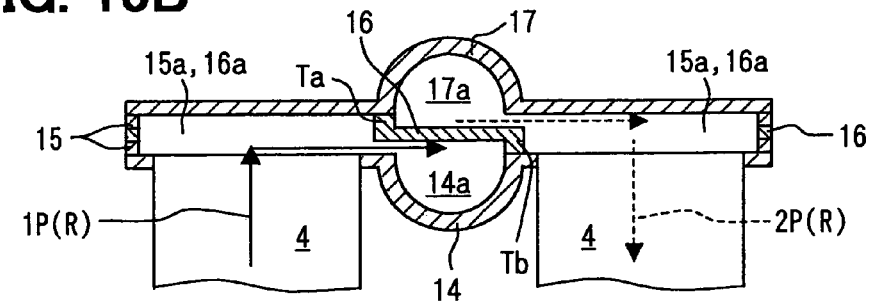
FIG. 15B is a cross-sectional view taken along line XVB-XVB in FIGS. 15A, and 15C is a cross-sectional view taken along line XVC-XVC in FIG. 15A.

Each of the space forming plates 15, 15' has space forming holes 15*a* at positions corresponding to the tube positions. The crossing plate 16 has communication holes 16*a* at positions corresponding to the tubes 4, and communication preventing portions Ta, Tb, Tc, Td. The communication preventing portions Ta-Td are formed by cutting and standing the plate material to prevent a communication between the communication portions 14*a*, 17*a*. Therefore, when the refrigerant stream after passing through the first refrigerant passing portion 1P is bent to the second refrigerant passing portion 2P in the refrigerant turning portion T, the refrigerant on one side (e.g., right side in FIG. 16) flows to the other side (e.g., left side in FIG. 16) through the communication portions 14*a* and 17*a*, as shown in FIGS. 15B, 15C, 16.

In this embodiment, a refrigerant joining space and a refrigerant distribution space are formed in the refrigerant turning portion T by using the space holes 15*a*, the communication holes 16*a* and the communication portions 14*a*, 17*a*. The two end portions of the communication portions 14*a*, 17*a* are sealed by caps 9. Those components parts are made of aluminum, and are integrally brazed in a furnace.

Figure 15C:
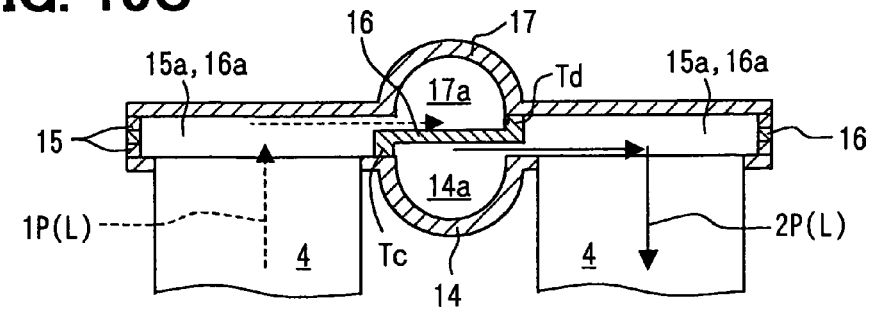
Figure 16:
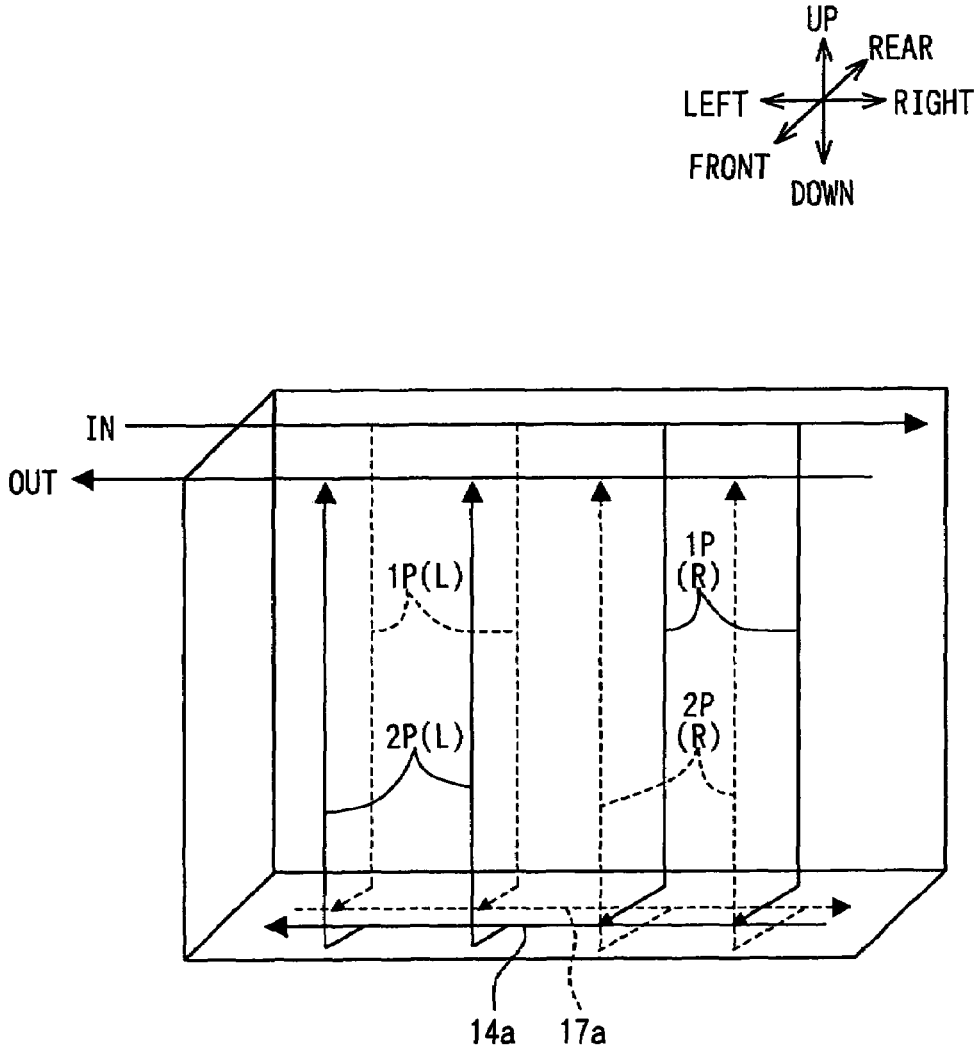
FIG. 16 is a schematic diagram showing a refrigerant flow in the refrigerant evaporator in FIG. 13.

FIG. 16 shows a schematic diagram showing a refrigerant flow in the refrigerant evaporator 1 of FIG. 13. In FIG. 16, the solid lines and the chain lines in the communication portions 14*a*, 17*a* correspond to those in FIG. 15B and FIG. 15C. The refrigerant from the tubes 4 in the first portion R on the first refrigerant passing portion 1P is joined into the communication portion 14*a* of the refrigerant turning portion T through the spaces 15*a*, 16*a*, as shown the solid line in FIG. 15B, 16. The refrigerant joined into the communication portion 14*a* flows through the communication portion 14*a* in the tank longitudinal direction as shown by the solid line in FIG. 16, and flows into the tubes 4 in a second part (L) on the second refrigerant passing portion 2P, as shown in FIGS. 15C and 16.

In contrast, the refrigerant from the tubes 4 in the second portion L on the first refrigerant passing portion 1P is joined into the communication portion 17*a* of the refrigerant turning portion T through the spaces 15*a*, 16*a*, as shown the chain line in FIG. 15C, 16. The refrigerant joined into the communication portion 17*a* flows through the communication portion 17*a* in a tank longitudinal direction as shown by the chain line in FIG. 16, and flows into the tubes 4 in the first part (R) on the second refrigerant passing portion 2P, as shown in FIGS. 15B and 16.

According to the third embodiment, the refrigerant evaporator 1 includes the core portion between the refrigerant turning portion T, and the upstream tank portion 2 and the downstream tank portion 3. The core portion includes the first refrigerant passing portion 1P and the second refrigerant passing portion 2P. The refrigerant turning portion T has a refrigerant joining space (15*a*, 16*a*) for joining the refrigerant after passing through the tubes in the first refrigerant passing portion 1P, a refrigerant distribution space (15*a*, 16*a*) for distributing the refrigerant to the second refrigerant passing portion 2P, and the two communication portions 14*a*, 17*a* for communicating the refrigerant joining space (15*a*, 16*a*) and the refrigerant distribution space (15*a*, 16*a*).

Each of the first refrigerant passing portion 1P and the second refrigerant passing portion 2P is constructed with all the tubes 4 laminated on one line in a laminating direction. The first refrigerant passing portion 1P can be divided into the first and second parts R, L (e.g., right and left areas in FIG. 16), and the second refrigerant passing portion 2P can be divided into the first and second parts R, L (right and left areas in FIG. 16), as shown in FIG. 16. Furthermore, as shown in FIG. 16, the refrigerant joining space (15*a*, 16*a*) corresponding to the first part R in the first refrigerant passing portion 1P communicates with the refrigerant distribution space (15*a*, 16*a*) corresponding to the second part L in the second refrigerant passing portion 2P through the communication portion 14*a*. Similarly, the refrigerant joining space (15*a*, 16*a*) corresponding to the second part L in the first refrigerant passing portion 1P communicates with the refrigerant distribution space (15*a*, 16*a*) corresponding to the first part R in the second refrigerant passing portion 2P through the communication portion 17*a*.

Even in this refrigerant evaporator 1, the upstream tank portion 2 and the downstream tank portion 3 can be formed to have the structure described in the second embodiment. In this case, the refrigerant distribution in the refrigerant evaporator 1 can be made more uniform.

According to the third embodiment, the core portion is divided into four parts in the front-rear direction (air flowing direction) and right-left direction (tube laminating direction), as shown in FIG. 16. The refrigerant stream is turned within the refrigerant turning portion T between the first refrigerant passing portion P1 (first line) and the second refrigerant passing portion P2 (second line), while refrigerant flows in the tank longitudinal direction (right-left direction) in FIG. 16. That is, the refrigerant stream from the first part R in the first line (1P) is turned to the second part L in the second line (2P), and the refrigerant stream from second part L in the first line (1P) is turned to the first past R in the second line (2P) through the pair of the communication portions 14*a*, 17*a*, within the refrigerant turning portion T. That is, the refrigerant streams are turned in a cross pattern in the refrigerant turning portion T. Accordingly, air blown from the all surface area of the core portion can be made uniform.

Other Embodiments

Although the present invention has been described in connection with some preferred embodiments thereof with reference to the accompanying drawings, it is to be noted that various changes and modifications will become apparent to those skilled in the art.

For example, in the above-described embodiments, a refrigerant evaporator 1 is typically used for a super-critical refrigerant cycle system. However, the refrigerant evaporator 1 can be used for any a refrigerant cycle system, and any refrigerant other than CO2 can be used as the refrigerant. Further, the present invention is typically used for a refrigerant evaporator, in the above-described embodiments. However, the present invention can be used for a heat exchanger for heating or cooling. Only when a first medium in a heat exchanger is heat-exchanged with a second medium outside the heat exchanger, the present invention can be suitably used for the heat exchanger. In this case, the up-down arrangement of the heat exchanger can be suitably changed without being limited to the arrangement of the above-described embodiments.

While the invention has been described with reference to preferred embodiments thereof, it is to be understood that the invention is not limited to the preferred embodiments and constructions. The invention is intended to cover various modification and equivalent arrangements. In addition, while the various elements of the preferred embodiments are shown in various combinations and configurations, which are exemplary, other combinations and configuration, including more, less or only a single element, are also within the spirit and scope of the invention.

What is claimed is:

1. A heat exchanger comprising:

a core portion including a plurality of tubes extending in a tube longitudinal direction, in which a first medium flows, the core portion being disposed to perform heat exchange between the first medium flowing in the tubes and a second medium passing through the core portion outside the tubes; and an upstream tank portion, connected to one end of the tubes and extending in a tank longitudinal direction perpendicular to the tube longitudinal direction, for distributing and supplying the first medium into the tubes, wherein the upstream tank portion comprises a first distribution passage for distributing the first medium in the tank longitudinal direction so as to distribute the first medium into the tubes laminated in a direction parallel to the tank longitudinal direction, a plurality of second distribution passages provided to respectively correspond to the tubes, the plurality of second distribution passages being configured to distribute the first medium from the first distribution passage into the tubes in a tank width direction that is perpendicular to both the tube longitudinal direction and the tank longitudinal direction, and a plurality of communication passage through which the first medium flowing in the tank longitudinal direction via the first distribution passage is supplied to the second distribution passages; wherein the plurality of communication passages are provided to respectively correspond to the tubes; and the plurality of second distribution passages are located at positions offset from the first distribution passage in the tank width direction.

2. The heat exchanger according to claim 1, wherein the first medium is a refrigerant and is evaporated while performing heat exchange with the second medium in the core portion.

3. The heat exchanger according to claim 1, wherein the first distribution passage, the plurality of second distribution passages and the plurality of communication passages are provided in the upstream tank portion by stacking at least first, second and third plate members in the tube longitudinal direction.

4. The heat exchanger according to claim 1, wherein the first distribution passage, the plurality of second distribution passages and the plurality of communication passages are provided in the upstream tank portion by stacking at least first to fifth plate members in the tube longitudinal direction.

5. The heat exchanger according to claim 4, wherein the plurality of communication passages are provided to extend in the tank longitudinal direction.

6. The heat exchanger according to claim 4, wherein:

the first plate member and the second plate member are constructed with an integrated plate; and the integrated plate has connection holes which are connected to the tubes and protrude to the core portion.

7. The heat exchanger according to claim 4, wherein:

the first plate member is connected to the tubes;

the second plate member is stacked on the first plate member to have space holes communicating with the tubes;

the third plate member is stacked on the second plate member to form the plurality of second distribution passages;

the fourth plate member is stacked on the third plate member to form the plurality of communication passages; and the fifth plate member is stacked on the fourth plate member to form the first distribution passage.

8. The heat exchanger according to claim 7, further comprising a fastening member extending from the first plate member in the tube longitudinal direction to fasten the first to fifth plate members.

9. The heat exchanger according to claim 7, wherein space holes are provided in the fourth plate to communicate with each other in the tank longitudinal direction, and the space holes form the plurality of communication passages.

10. The heat exchanger according to claim 5, wherein:

the third plate member has space holes for forming the plurality of second distribution passages, at positions corresponding to the tubes in the tank longitudinal direction; and areas of the space holes are set to be gradually larger from an end portion adjacent to a refrigerant inlet to the other end portion in the tank longitudinal direction.

11. The heat exchanger according to claim 1, wherein:

the first distribution passage and the plurality of communication passages are formed by a single plate member;

the single plate member has a first protrusion portion protruding to outside and extending in the tank longitudinal direction, and a plurality of second protrusion portions protruding to outside and extending in the tank width direction; and the first distribution passage is provided inside the first protrusion portion and the plurality of communication passages are provided inside the second protrusion portions.

12. The heat exchanger according to claim 1, wherein:

the first distribution passage is provided at a center area in the tank width direction; and the plurality of second distribution passages are provided at two sides of the first distribution passage in the tank width direction.

13. The heat exchanger according to claim 1, further comprising a downstream tank portion extending in the tank longitudinal direction, in which the first medium flowing out of the tubes is joined, wherein:

the downstream tank portion has a first joining passage for passing and joining the first medium in a direction parallel to the tube longitudinal direction, and a second joining passage for passing and joining the first medium in the tank longitudinal direction.

14. The heat exchanger according to claim 13, wherein:

the downstream tank portion includes a partition portion for partitioning the first joining passage and the second joining passage, and the partition portion has communication holes through which the first joining passage communicates with the second joining passage; and the communication holes are provided in the partition portion to prevent a bias flow of the first medium in the tubes.

15. The heat exchanger according to claim 14, wherein the communication holes are set such that a total area of the communication holes is larger than a total passage sectional area of the tubes.

16. The heat exchanger according to claim 13, wherein the downstream tank portion is integrated with the upstream tank portion at one end side of the core portion.

17. The heat exchanger according to claim 13, wherein the tubes are divided into a first passing portion in which the tubes are arranged in a first line and communicate with the upstream tank portion at one end side in the tube longitudinal direction, and a second passing portion in which the tubes are arranged in a second line and communicate with the downstream tank portion at the one end side in the tube longitudinal direction, the heat exchanger further comprising a refrigerant turning portion provided to communicate with the tubes of the first passing portion and the tubes of the second passing portion at the other end side in the tube longitudinal direction, wherein the upstream tank portion and the downstream tank portion are integrated.

18. The heat exchanger according to claim 17, wherein:

the refrigerant turning portion has a medium joining space into which the first medium from the tubes of the first passing portion is joined at a position corresponding to the first passing portion, a medium distribution space for distributing the first medium into the tubes of the second passing portion at a position corresponding to the second passing portion, and a pair of first and second communication portions which are provided at a portion within the medium joining space and the medium distribution space in the tank width direction, so as to partition the medium joining space into a first joining part and a second joining part and to partition the medium distribution space into a first distribution part and a second distribution part in the tank longitudinal direction; and the first joining part communicates with the second distribution part and the second joining part communicates with the first distribution part through the pair of the first and second communication portions.

19. A heat exchanger comprising:

a core portion including a plurality of tubes extending in a tube longitudinal direction, the plurality of tubes being stacked in a stacking direction generally perpendicular to the tube longitudinal direction;

a tank portion connected to one end of each of the tubes, the tank portion extending in the stacking direction of the tubes;

a first distribution passage defined by the tank portion, the first distribution passage extending in the stacking direction of the tubes, the first distribution passage being in communication with a flow passage defined by each of the plurality of tubes;

a plurality of pairs of second distribution passages defined by the tank portion, each passage of each of the pairs of second distribution passages being in communication with the first distribution passage, each of the plurality of pairs of second distribution passages being in communication with the flow passage defined by a respective tube;

a communication passage disposed between the first distribution passage and each of the plurality of pairs of second distribution passages, the communication passage being in direct communication with the first passage and a respective pair of second distribution passages.

20. The heat exchanger according to claim 19, wherein each of the pairs of second distribution passages are spaced from the first distribution passage in a width direction of the plurality of tubes, the width direction being generally perpendicular to the longitudinal direction and stacking direction of the tubes.

21. The heat exchanger according to claim 19, wherein one of each of the pairs of second distribution passages is in communication with a first end of the flow passage defined by the respective tube and the other of each of the pairs of second distribution passages is in communication with a second end of the flow passage defined by the respective tube, the first end and the second end being at opposite sides of the respective tube in a width direction of the tube, the width direction being generally perpendicular to the longitudinal direction and stacking direction of the tubes.

* * * * *